United States Patent [19]

Cronk

[11] 4,157,098

[45] Jun. 5, 1979

[54] PORTABLE SHELTER

[76] Inventor: Byron W. Cronk, P. O. Box 82, Huntley, Mont. 59037

[21] Appl. No.: 871,358

[22] Filed: Jan. 23, 1978

[51] Int. Cl.[2] ..... A45F 1/16

[52] U.S. Cl. ..... 135/3 R; 135/15 PE; 135/15 PQ; 135/DIG. 1

[58] Field of Search ..... 135/1 R, 3 R, 15 PE, 135/15 PQ, DIG. 1; 52/641

[56] References Cited

U.S. PATENT DOCUMENTS

| | | | |
|---|---|---|---|
| 462,077 | 10/1891 | Goss | 135/3 R |
| 1,315,097 | 9/1919 | Denney | 135/67 X |
| 2,711,180 | 6/1955 | Sims et al. | 135/3 R |
| 3,957,069 | 5/1976 | Denaro | 135/15 PE |

FOREIGN PATENT DOCUMENTS

| | | | |
|---|---|---|---|
| 971346 | 9/1964 | United Kingdom | 135/3 R |

*Primary Examiner*—Benjamin W. Wyche
*Assistant Examiner*—Conrad L. Berman
*Attorney, Agent, or Firm*—Arthur L. Urban

[57] ABSTRACT

A portable shelter including a plurality of sidewall framing sections, a plurality of connectors joining adjacent sidewall sections to form spaced parallel vertical sidewalls, a plurality of arched crossmembers joining the top portions and the end portions of the spaced vertical sidewalls, crossbrace members extending between adjacent end portions of the spaced sidewalls, and a covering of a flexible sheet material disposed over the assembled sidewall sections and arched crossmembers; the sidewall framing sections being formed of four straight lengths of tubing affixed perpendicular to each other with the ends of each length of tubing extending a significant distance beyond the crossing point thereof with lengths of tubing perpendicular thereto, certain of the sidewall framing sections being of a square configuration of equal height and width and having a length of tubing disposed intermediate and parallel to the lengths of tubing forming opposite sides of the sidewall sections, and other of the sidewall sections being of a rectangular configuration with a height equal to the sidewall sections of square configuration and a width approximately one-half the height and having diagonal brace members connecting opposite crossing points of the lengths of tubing; and said sidewall framing sections being reversible and investable and capable of accommodating the ends of said arched crossmembers in any orientation.

10 Claims, 10 Drawing Figures

PORTABLE SHELTER

This invention relates to a novel portable shelter and more particularly relates to a new shelter which can be assembled from components.

A wide variety of portable shelters and enclosures have been used in the past for storage and other purposes. Although special designs have been proposed for particular uses, e.g., inflatable air houses, prefabricated buildings and the like, most shelters have been jerry built as needed. This has resulted in structures of poor design both from an engineering and cost standpoint. The structures are not durable frequently and often are unsafe. In addition, the structures are costly both in their original cost and in the time and labor involved in erecting them.

A further disadvantage of known shelters is that they ordinarily must be dismantled for moving, even though the move is only for a short distance on the same job site. Dismantling may be necessary because of the weight of the assembled structure and/or the lack of structural rigidity thereof. In either case, extra labor and time are required to dismantle the shelter and then to erect it again at a nearby location. Also, many shelters utilize special components which are difficult to repair or replace if they become damaged or lost.

The relocation of a structure simply and conveniently is an important consideration, particularly with structures which are used as shelters in the construction industry. For example, in the building of concrete or masonry walls, it is necessary that the newly placed concrete or mortar does not freeze. To avoid freezing, temporary shelters are built around the wall area and heat supplied to the shelter.

When the concrete or mortar has set up sufficiently, the shelter is dismantled and moved to a new wall-forming area. To minimize shelter costs, it is desirable to use the same shelter on succeeding portions of the same job. However, if the dismantling and re-erection of the shelter cannot be accomplished quickly and efficiently, it is necessary to employ extra shelters so the wall-forming operations do not cause delays in the wall construction. If extra shelters are not utilized, additional laborers or overtime may be required to relocated the shelters. Neither alternative is desirable since each increases costs which must be absorbed by the contractor or passed on to the customer.

The present invention provides a novel portable shelter which can be erected simply and conveniently. Furthermore, the shelter of the invention is light in weight and can be moved to another location of a job site without dismantling. The shelter can be moved quickly by a few men. Thus, delays and work stoppage are substantially eliminated.

The shelter of the present invention can be erected using only a few different standard components. This simplification of components eliminates the large inventory of spare parts which ordinarily is required. Further, the standard components of the shelter can be assembled in a large number of different configurations to provide customized shelters for a variety of uses. Also, the components of the shelter of the invention can be assembled without special tools by unskilled labor.

Another advantage of the shelter of the present invention is that the standard components used in the erection thereof can be fabricated from materials which are commercially available. Also, the required components can be fabricated simply and inexpensively without special machinery or fabricating procedures. Moreover, the smaller parts used in the erection of the shelter of the invention that might be lost more easily are inexpensive and commonly available from a variety of sources.

Other benefits and advantages of the novel shelter of the present invention will be apparent from the following description and the accompanying drawings in which.

Figure 1:
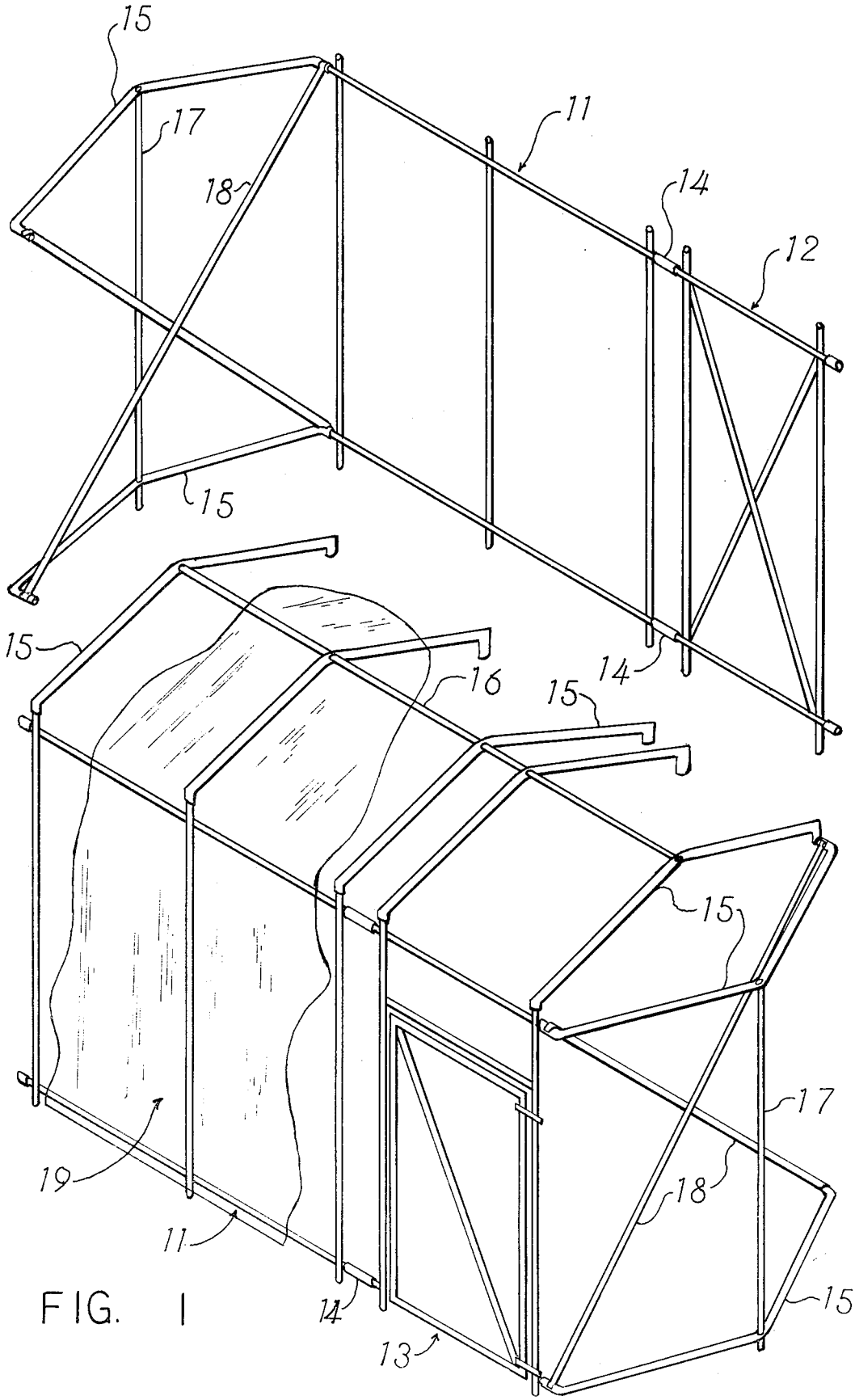
FIG. 1 is a view in perspective of one form of the novel shelter of the present invention with portions separated.
Figure 2:
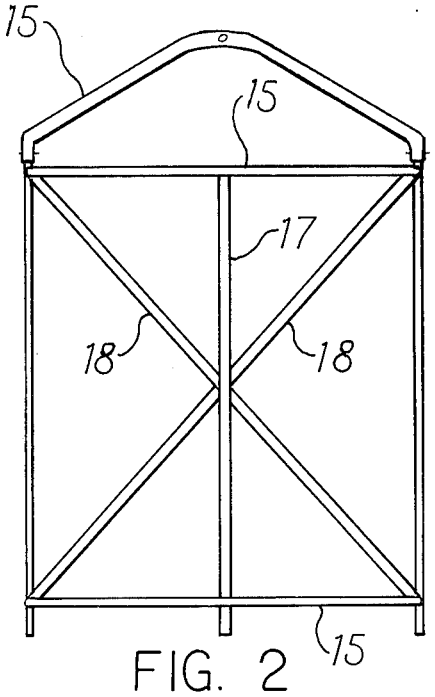
FIG. 2 is an end view of the shelter shown in FIG. 1.
Figure 3:
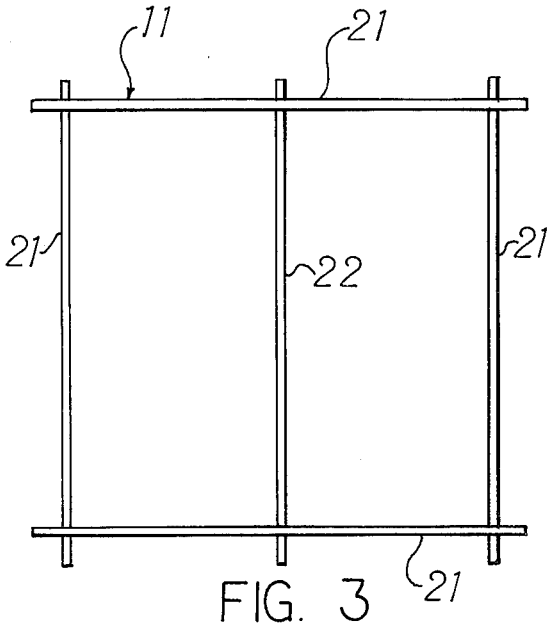
FIG. 3 is a side elevation of one form of sidewall framing section of the shelter shown in FIG. 1.
Figure 4:
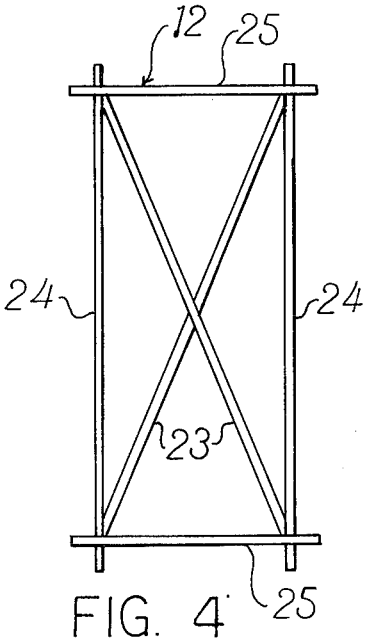
FIG. 4 is a side elevation of another form of sidewall framing section of the shelter shown in FIG. 1.
Figure 5:
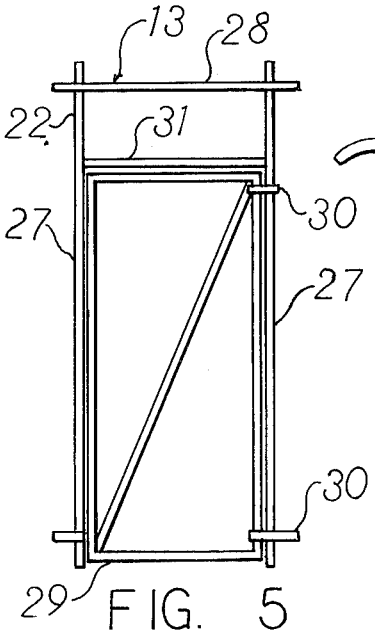
FIG. 5 is a side elevation of a door section of the shelter shown in FIG. 1.
Figure 6:
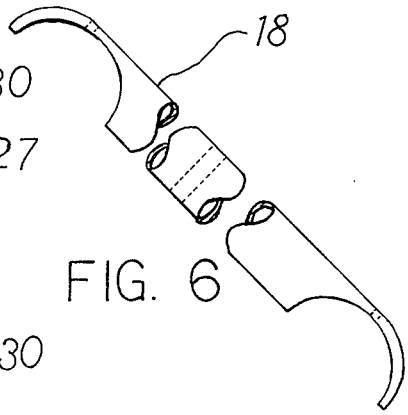
FIG. 6 is a side elevation of a crossbrace member of the shelter shown in FIG. 1.
Figure 7:
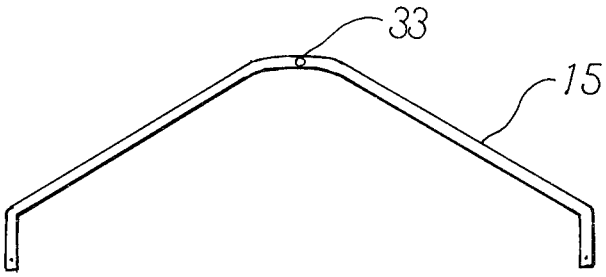
FIG. 7 is a side elevation of an arched crossmember of the shelter shown in FIG. 1.

As shown in the drawings, a novel shelter of the present invention includes sidewall framing sections 11 and 12 and door section 13. These sections 11, 12 and 13 are joined together with connectors 14 to form vertical sidewalls. Two sidewalls which are positioned in a spaced parallel relationship are joined by a plurality of arched crossmembers 15. The arched crossmembers 15 join the top portions of the sidewalls as well as the end portions thereof. Arched crossmembers 15 each have a transverse central opening to receive a common roof brace member 16 and an end brace member 17. Also, crossbrace members 18 extend between adjacent end portions of the spaced sidewalls. In addition, the shelter includes a covering 19 of a flexible sheet material.

The sidewall framing sections 11 and 12 are formed of straight lengths of tubing or conduit. Sidewall sections are formed of four peripheral lengths of tubing which are affixed perpendicular to each other with the ends of each length of tubing extending a significant distance beyond the crossing points thereof with the lengths perpendicular thereto. Advantageously, the ends of the tubing extend about six inches or so.

Sidewall framing sections 11 are of a square configuration with tubing 21 of equal length around the periphery of the sections, preferably about ten feet or so. Each section 11 has a length of tubing 22 disposed intermediate and parallel to the tubing 21 which forms the opposite sides of the sections. The ends of tubing 22 also extend beyond the tubing 21 which it crosses.

Sidewall framing sections 12 and door sections 13 are of rectangular configuration with a height equal to the square sidewall framing sections 11 and a width approximately one-half the height. Sidewall sections 12 have diagonal brace members 23 connecting opposite crossing points of the lengths of tubing 24 and 25 forming the periphery of the sections.

Door sections 13 are formed of side tubing 27 and top tubing 28. Door 29 may be pivotally connected to one of the side tubes 27 with appropriate hardware including hinges 30 which may be of the type conventionally used with gates. A brace 31 may be located above the door 29 to provide a clear opening below the door.

Arched crossmembers 15 are used to join parallel sidewalls formed from sidewall framing sections 11 and 12 and door section 13. The arched crossmembers 15 which join the top portions of the sidewalls act as roof framing. In the same way, the arched crossmembers 15 which connect the end portions of the sidewalls serve as end framing. Arched crossmembers 15 each have a central opening 33. These openings 33 enable a common brace member 16 to be inserted therethrough to reinforce the roof framing formed by arched crossmembers 15. Similarly, brace member 17 connects and reinforces the upper and lower arched end members 15. Diagonal brace members 18 which also reinforce the ends of the shelter have flattened end portions curved to mate with the ends of the arched end members 15.

The various components of the shelter of the present invention are sized to provide easy assembly of the shelter. As shown particularly in FIG. 8, connectors 14 and arched crossmembers 15 have an inside tubing diameter slightly larger than the outside diameter of the tubing of the sidewall framing sections 11 and 12 and the door sections 13. This difference in sizing permits the ends of the connectors 14 and the ends of the arched crossmembers 15 to be slidably disposed over the ends of the tubing extending from the sidewall sections 11 and 12 and the door section 13.

Figure 8:
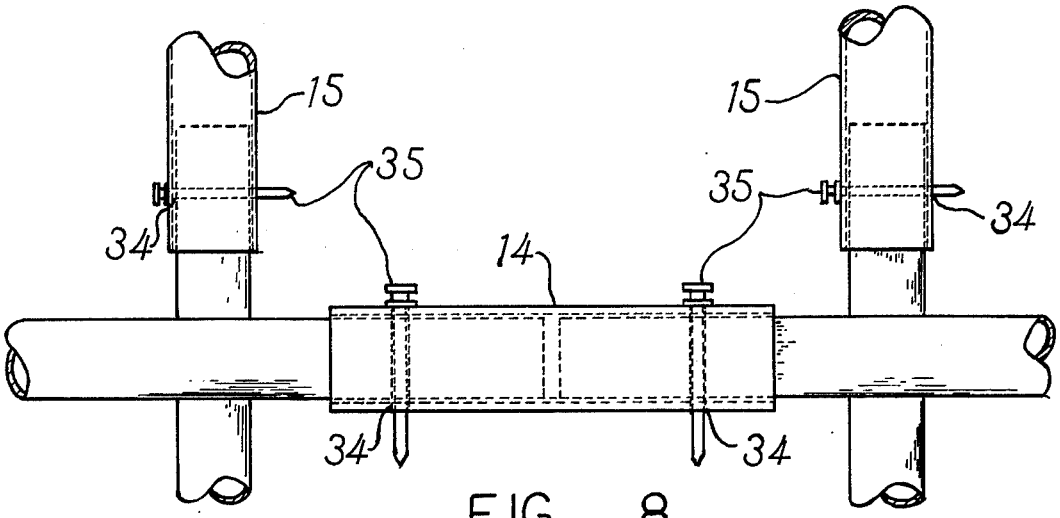
FIG. 8 is an enlarged fragmentary view of an assembly of components of the shelter shown in FIG. 1.

To provide secure connections between the various components of the shelter, the components have transverse openings 34 adjacent the free ends thereof. When the components are properly assembled together, the openings 34 in the respective components become aligned with corresponding openings 34 in the adjoining components as shown in FIG. 8. Suitable connecting bolts or pins 35 then can be inserted through the aligned openings 34 to secure the components to each other. The use of commercially available duplex nails as shown is advantageous because of the double head which facilitates insertion and removal. Also, since the pins or nails 35 are quite small and can be lost or misplaced easily, the use of duplex nails is desirable because of their low cost and easy availability.

Figure 9:
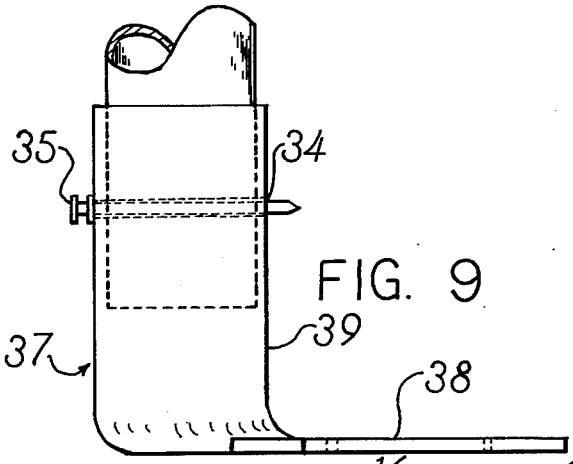
FIG. 9 is an enlarged fragmentary view of an anchor on a projecting end of a sidewall section of a shelter of the invention.
Figure 10:
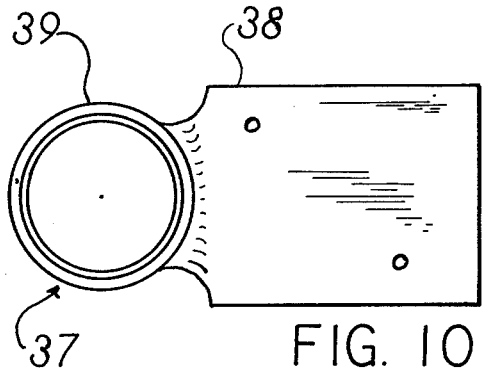
FIG. 10 is a top view of the anchor shown in FIG. 9.
Figure 11:
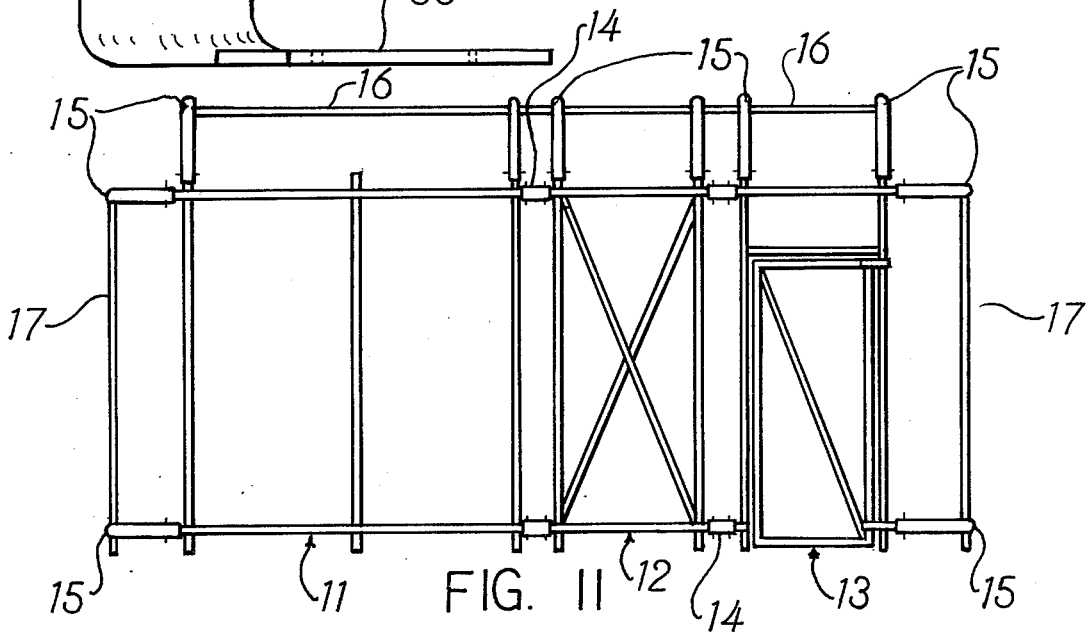
FIG. 11 is a side elevation of another form of the shelter of the present invention.

Suitable anchors 37 may be utilized as shown in FIG. 9 to secure the shelter to a base such as a peripheral rail or board or other foundation (not shown). Anchors 37 may be formed of tubing having an inside diameter slightly larger than the outside diameter of the tubing of the sidewall sections 11 and 12 and the door section 13. One end 38 of the anchor tubing may be flattened and bent perpendicular to the open portion 39 of the tubing. The anchors 37 have transverse openings 34 similar to the openings of the other components to secure the sidewall sections 11 and 12 and the door section 13 to the anchors with pins or nails 35.

The tubing employed in the fabrication of the various components used in the shelter of the invention may be any of the rigid tubing or piping that is available commercially. While the tubing used is generally round in cross section, other configurations such as square tubing may be employed so long as the proper sizing is maintained for the overlapping fit of the free ends of the respective components. Also, the tubing ordinarily is metal tubing, although other materials such as plastic may be utilized under particular conditions. In fact, the tubing of the sidewall sections 11 and 12 could be solid plastic rods of light weight since they are ordinarily inserted into the larger diameter tubing of the connectors and the arched crossmembers.

The tubing is fabricated into the designs shown in the drawings for the specific components by brazing, welding or other fastening methods which provide secure attachment of the tubing for durability and rigidity. Generally, the use of tubing one size larger for the arched crossmembers and connectors than the size employed for the tubing of the sidewall sections and the door sections provides the necessary size differential for proper assembly of the components to form the shelter. One useful combination is the use of one inch conduit for the larger tubing and three-fourths inch diameter conduit for the smaller tubing. However, larger and heavier weight tubing may be more desirable for certain applications.

The covering of flexible sheet material which is disposed over the assembled framework of the shelter may be any of the materials that are conventionally used as tenting, tarpaulin and similar materials. Canvas, plastic films and the like may be employed as the covering of the shelter as desired. The covering can be attached or secured to the framework in a variety of ways including tie ropes or wires, laths or bats in combination with staples, wires, etc. and similar fastening systems.

The above description and the accompanying drawings show that the present invention provides a novel shelter which can be erected simply and conveniently by unskilled labor without special tools. Moreover, the shelter of the invention can be moved from one location to another on a job site without dismantling the shelter. The moving can be done by a few men without difficulty in a short time so delays and work stoppage are substantially eliminated.

Only a minimum of different standard components are required for the erection of the shelter of the invention. In spite of the minimum number of different components, many different configurations can be assembled to provide customized shelters for a variety of uses. The simplification of components eliminates the requirement for a large inventory of spare parts. Further, the smaller parts which are easily lost or misplaced are inexpensive and commonly available from a variety of sources.

Also, the standard components used in the erection of the novel shelter of the invention can be fabricated from materials which are commercially available. In addition, the components can be fabricated simply and inexpensively without the use of special machinery or fabricating procedures.

It will be apparent that various modifications can be made in the particular shelter described in detail above and shown in the drawings within the scope of the invention. For example, the door may be attached between sidewall sections using filler tubing rather than a prefabricated door section. Also, coverings can be applied to individual sidewall sections prior to assembly if desired. Therefore, the scope of the invention is to be limited only by the following claims.

What is claimed is:

1. A portable shelter including a plurality of sidewall framing sections, a plurality of connectors joining adjacent sidewall sections to form vertical sidewalls, a plurality of arched crossmembers extending from the top portions and the end portions of said vertical sidewalls, crossbrace members extend-between adjacent end portions of said sidewalls, and a covering of a flexible sheet material disposed over the assembled sidewall sections and arched crossmembers; said sidewall framing sections being formed of four straight lengths of tubing affixed perpendicular to each other with the ends of each length of tubing extending a significant distance beyond the crossing point thereof with lengths of tubing perpendicular thereto, certain of said sidewall framing sections being of a square configuration of equal height and width and having a length of tubing disposed intermediate and parallel to the lengths of tubing forming opposite sides of the sidewall sections, and other of said sidewall sections being of a rectangular configuration with a height equal to the sidewall sections of square configuration and a width approximately one-half the height and having diagonal brace members connecting opposite crossing points of the lengths of tubing, and said sidewall framing sections being reversible and invertable and capable of accommodating the ends of said arched crossmembers in any orientation; said arched crossmembers each having a transverse central opening to receive a common roof or end brace member; said arched crossmembers and said connectors having an inside tubing diameter slightly larger than the outside diameter of the tubing of said sidewall sections so that the ends of said arched crossmembers and said connectors can be slidably disposed over the tubing ends extending from said sidewall sections in the erection of said shelter; and matching transverse openings in the tubing of said sidewall sections, said arched crossmembers, said connectors and said crossbrace members for insertion of connecting pins to secure the respective components to each other.

2. A portable shelter according to claim 1 wherein the lengths of tubing of said sidewall sections are brazed or welded to each other.

3. A portable shelter according to claim 1 wherein a door is located in one of said sidewall sections.

4. A portable shelter according to claim 1 wherein said connecting pins are duplex nails.

5. A portable shelter according to claim 1 wherein the tubing of said sidewall sections is three-fourths inch diameter conduit and the tubing of said arched crossmembers and said connectors is one inch diameter conduit.

6. A portable shelter according to claim 1 wherein the height of said sidewall sections is about ten feet.

7. A portable shelter according to claim 1 wherein the tubing ends of said sidewall sections extend about six inches.

8. A portable shelter according to claim 1 wherein said covering of flexible sheet material is a plastic film.

9. A portable shelter according to claim 1 wherein anchors are disposed over the tubing ends extending from the bottom of said sidewall sections.

10. A portable shelter according to claim 9 wherein said anchors are formed of tubing having an inside diameter slightly larger than the outside diameter of the tubing of said sidewall sections with one end of said anchor tubing being flattened and bent perpendicular to the open portion thereof.

* * * * *